United States Patent [19]

Garner

[11] Patent Number: 4,856,267

[45] Date of Patent: Aug. 15, 1989

[54] METHOD AND APPARATUS FOR TWISTING TOGETHER LENGTHS OF FILAMENTARY MATERIAL

[75] Inventor: John N. Garner, Kingston, Canada

[73] Assignee: Northern Telecom Limited, Montreal, Canada

[21] Appl. No.: 275,984

[22] Filed: Nov. 25, 1988

[51] Int. Cl.[4] ..... D01H 7/86; D01H 13/10; D07B 3/12

[52] U.S. Cl. ..... 57/58.52; 57/58.83

[58] Field of Search ..... 57/58.49, 58.52, 58.83

[56] References Cited

U.S. PATENT DOCUMENTS

| | | | |
|---|---|---|---|
| 2,442,775 | 6/1948 | Nelson | 57/58.52 X |
| 2,718,363 | 9/1955 | Roberts | 57/58.52 X |
| 3,119,224 | 1/1964 | Kocks | 57/58.52 |
| 3,552,693 | 1/1971 | Scherf | 57/58.52 X |
| 3,715,877 | 2/1973 | Akachi . | |
| 3,717,989 | 2/1973 | Heiman et al. | 57/58.52 |
| 3,774,385 | 11/1973 | Maderna | 57/58.52 |
| 4,439,979 | 4/1984 | Winkelmann | 57/58.52 X |
| 4,736,579 | 4/1988 | Stenmans | 57/58.52 |

FOREIGN PATENT DOCUMENTS 1303106 1/1970 United Kingdom .

*Primary Examiner*—Donald Watkins
*Attorney, Agent, or Firm*—R. J. Austin

[57] ABSTRACT

Method and apparatus for twisting conductors into a twisted pair in which the conductos are passed from two axially aligned reels and axially out of a cylinder. The conductors pass through one twist position axially at one end of the cylinder, extend around the cylinder and along the cylinder to the other end to a second twist position. The conductors are drawn along their paths during rotation of a flyer radially outside the cylinder. Speed of rotation of the conductors leaving the reels forces the conductors against the inner surface of the cylinder against which the conductors slide as they move towards the first twist position. The flyer means is provided, preferably, upon the outer surface of the cylinder.

17 Claims, 6 Drawing Sheets

METHOD AND APPARATUS FOR TWISTING TOGETHER LENGTHS OF FILAMENTARY MATERIAL

This invention relates to methods and apparatus for twisting together lengths of filamentary material.

Problems are associated with the twisting together of lengths of filamentary material in different usages. Many of these problems are associated with the degree of tension and methods of applying tension to the lengths of filamentary material as they are pulled along paths during a twisting procedure. Such problems appertain in particular in the manufacture of telecommunications cable, i.e. in the twisting together of two or more lengths of filamentary material in the form of individually insulated conductors.

In a conventional method of twisting two lengths of individually insulated conductor into a twisted pair for use in the telecommunications industry, each individually insulated conductor is drawn from its own individual supply reel, the two reels being mounted upon a supply carriage. A take-up reel provides the pulling tension and each of the supply reels is provided with a brake mechanism to ensure that the conductors are not drawn too rapidly from the reels whereby control is maintained over the twisting process. The brake mechanisms are operated by a tension arm provided for each reel. Each insulated conductor is passed tangentially from its supply reel and around a tensioning pulley mounted on a pivoted tension arm. Should a conductor issue from a supply reel too quickly, then the tension arm is allowed to pivot under a spring force so as to apply the brake mechanism to the supply reel whereby resistance is increased to rotation of the reel, thereby restraining unreeling of the conductor. The resistance offered by the brake is immediate and this applies a sudden increase in tension to the conductor.

These brake applications are spasmodic and sudden changing tensions in the conductor limit the speed of operation of the twisting machine and also place a limit on the smallest diameter wire which can be twisted in this type of operation. It has been calculated that the tension applied to the conductor when the brake is applied may be caused by a tensile load of about 6 lbs. Also, without operations of the brake, tension is applied because the pull of the conductor is required to produce reel rotation. As a result, it is considered that this type of twisting apparatus may not be safely used on a commercial basis for copper conductors below 26 AWG, if breakages are to be avoided at a running speed not in excess of 1200 rpm. Thus the speed of operation and the minimum size of the conductor to be twisted is dependent upon the wire strength and therefore upon the machine capability.

In addition, with the above type of conventional apparatus, a flyer is used to produce a double twisting operation. This flyer is rotatably mounted about an axis passing through the supply carriage so that the flyer rotates to sweep a volumetric space which includes both the supply carriage and the two supply reels. Because of the size of the various components including the supply reels, the sweep diameter of the flyer during rotation is of the order of about 3 ft for normal size reels and would be larger for larger reels.

In an alternative method which has been proposed for twisting wires together, British Patent Specification No. 1303106 discloses the positioning of three bobbins in axial alignment, each bobbin being wound with wire. The wires are fed from the bobbins through a collecting die and thence to a flybar which rotates around the bobbins. Because of the geometry of the apparatus, the flybar extends a substantial distance beyond the bobbins themselves. Part of the problem would appear to be that the wires after leaving the bobbins and approaching the die, balloon outwardly as they are rotated at high speed by their removal from the bobbins.

In a further disclosure, namely U.S. Pat. No. 3,715,877, granted Feb. 13, 1973, two stationary bobbins are mounted in apparatus and wires are drawn axially over the ends of the bobbins to twist them together. The drawing off of the wires for the bobbins is controlled by a flybar which rotates around the end of each bobbin and is frictionally held in position at its pivotal center so as to resist rotation and induce tension in the wire. With this apparatus, undoubtedly, tension is applied in each wire as it is being drawn off the bobbin by the need for the wire to rotationally drive its flybar. This apparatus is thus extremely restrictive upon the minimum diameter of wire which can be twisted and/or upon the running speed of the apparatus. Further to this, the latter document discloses complex machinery for the simple purpose of twisting wires together.

The present invention provides a method and apparatus for twisting together at least two lengths of filamentary material with a double twist and which also seeks to lessen or avoid the above disadvantages.

Accordingly, the present invention provides a method of twisting together at least two lengths of filamentary material with a double twist comprising: causing the lengths of material to follow paths from reels of material located in axial alignment within a surrounding concentric cylindrical means, the paths extending in one axial direction from the reel surfaces and between the surrounding cylindrical means and ends of the reels to a first twist position axially beyond the reels and substantially on the common axis of cylindrical means and reels, radially outwards from the cylindrical means to extend in the other axial direction through guide means radially outside the cylindrical means, and then axially away from the cylindrical means substantially on the axis thereof to a second twist position; and drawing the lengths of material along their paths while rotating the guide means around said axis, the lengths of material being unwound from the reels and forced, by the speed of rotation, against the inner surface of the cylindrical means, and sliding against said inner surface as they pass towards said first twist position.

According to the invention also there is provided apparatus for twisting together at least two lengths of filamentary material with a double twist comprising: a cylindrical means with a smooth inenr surface; mounting means within and at a first end of the cylindrical means for at least two axially aligned reels of filamentary material with the reels substantially concentric with the cylindrical means; a die concentrically disposed at the second end of the cylindrical means for causing convergence of the lengths and for leading them to a first twist position; fly means for the lengths of filamentary material, the fly means located radially outside the cylindrical means for directing the lengths axially from the second end towards the first end of the cylindrical means; means for rotating the fly means concentrically around the axis of the cylindrical means;

and a second twist position axially beyond the first end of the cylindrical means.

Preferably, in the apparatus of the invention, the fly means is located axially along the outside surface of the cylindrical means and the rotating means rotates the cylindrical means around its axis and around the mounting means.

In the use of the method and the apparatus according to the invention, the reels are not rotated by the lengths of filamentary material being drawn off them. In addition, the apparatus does not employ braking mechanisms for the reels nor does it employ conventional flybars for controlling the unwinding of the filamentary material. Thus, these particular items of conventional apparatus which add to the tension in the material are avoided. In the case of the method and the apparatus of the invention, resistance to movement of each length of filamentary material along its path and which causes tension in the material, need only be offered by frictional contact of the material with the surfaces of the cylindrical means and the fly means. The frictional coefficient may be reduced to a minimum by providing smooth finishes to inner and possibly outer surfaces of the cylindrical means and advantageously to the contacting surfaces of the guide means. Thus, substantially uniform and minimal tension results and this tension varies in negligible fashion for any increase in pulling load upon the material such as to increase its throughput speed. In addition, the lengths of material are not subjected to sudden tension increases such as are found when relying upon the pull of the filamentary material to rotate the reels to enable the unwinding process as in conventional apparatus.

As a result, because of the lessening of tension, and the avoidance of sudden increases in tension, such as for instance as provided by braking of reels, then the method and the apparatus of the invention may be used for double twisting together lengths of filamentary material of much smaller diameters than has heretofore been possible. In particular, with regard to the telecommunications industry, it has been found that the process and apparatus of the invention may provide a double twist to insulated copper wires with diameters as small as 36 AWG without resultant breakage. Also, because of the extremely small tensions involved, speeds of at least 2400 rpm of the flyer (i.e. 4800 twists per minute) are possible without breakage problems. The actual twist lay (i.e. the pitch) depends upon the throughput speed of the material, assuming that the flyer speed stays constant.

With the use and the method of the invention, the inner surface of the cylindrical means restricts the ballooning out of the filamentary material as it is being unwound from the reels. Thus, if the diameter of the cylindrical means is merely sufficient to allow the material to pass comfortably between the reel ends and the inner surface of the cylindrical means, then the radial dimensions of the apparatus are minimized. With regard to this, with use of conventional apparatus in the telecommunications industry for double twisting individually insulated conductor wires, the flyer bar has a diameter around 36 inches when using what are referred to as "half telephone reels". In the apparatus of the present invention, the flyer, when attached to the outside of the cylindrical means, need only have a diameter of approximately 24 inches when using larger reels known as "Hearl Heaton" reels. This smaller sweep diameter is sufficient for the cylindrical means to be positioned around Hearl Heaton reels which carry approximately up to four times the length of conductor wire that may possibly be carried by half telephone reels used in the conventional equipment.

In the apparatus of the invention, reels within the cylindrical means may be either stationary or rotatably driven, driving of the reels affecting the twist lay. If the reels are driven, they should be driven at rotational speeds less than that of the guide means. Driving of the reels does not assist in drawing off the filamentary material which, as has been stated, is merely unwound from each reel as it is pulled axially over the reel end.

One embodiment of the invention will now be described by way of example, with reference to the accompanying drawings, in which.

Figure 1:
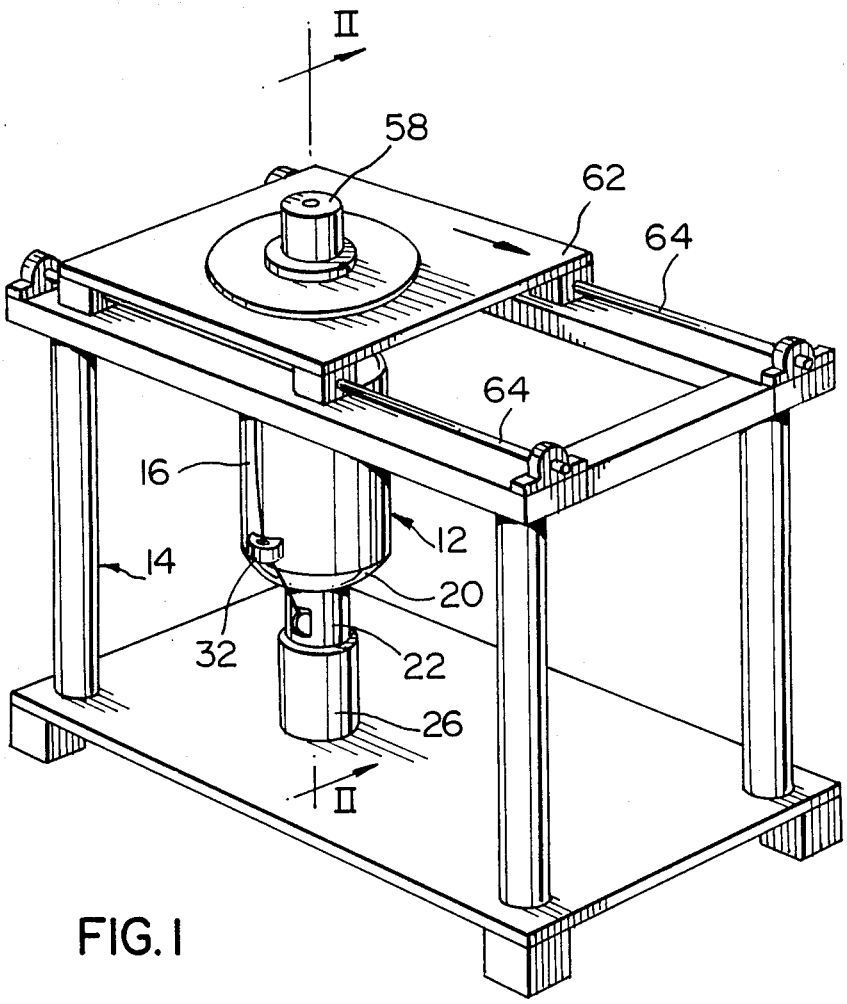
FIG. 1 is an isometric view of apparatus for providing a double twist to individually insulated conductors for a telecommunications cable, the apparatus being in closed condition.

As shown in FIG. 1, apparatus for providing a double twist to two lengths of individually insulated conductor generally comprises a cylindrical means which is a cylinder 12 rotatably mounted in a frame 14.

Figure 2:
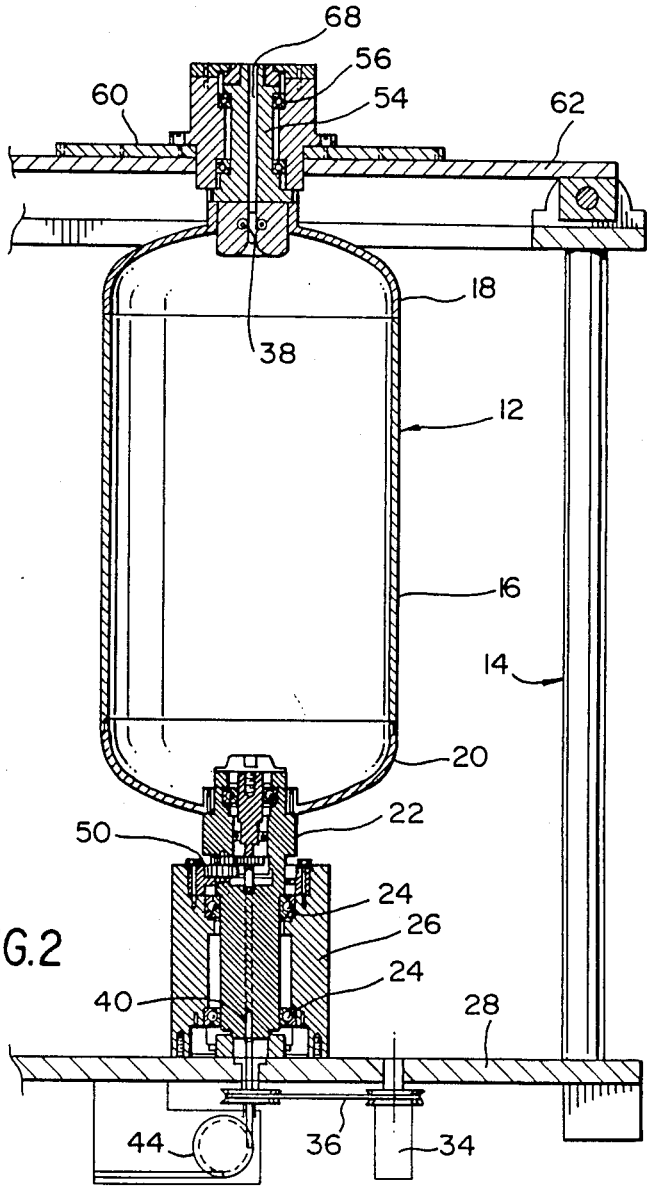
FIG. 2 is a cross-sectional view, to a larger scale, through the apparatus taken along line II—II in FIG. 1 and showing rotational parts of the apparatus in one angular position.

As shown more particularly in FIG. 2, the cylinder 12 comprises a truly cylindrical section 16 and two domed end sections, an upper domed end section 18 and a lower domed end section 20. The lower domed end section is secured to a downwardly extending drive shaft 22 which is mounted in bearings 24 within a cylindrical mounting 26 which is, in turn, secured to and extends upwardly from a lower plate 28 of the frame structure 14.

Figure 3:
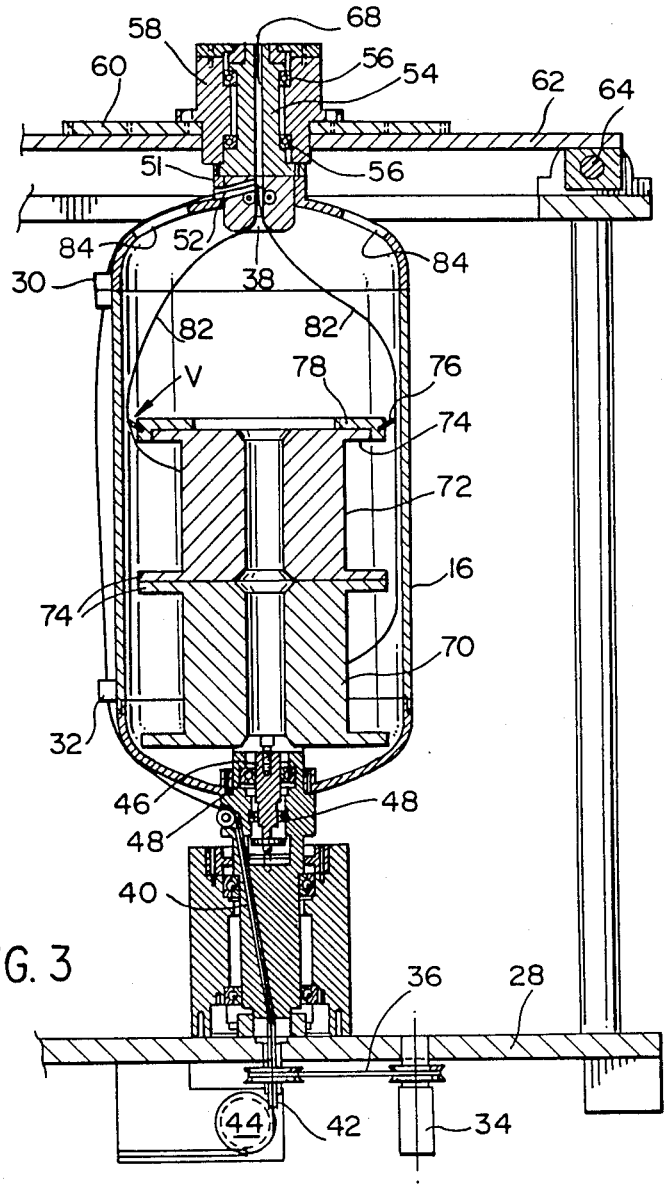
FIG. 3 is a view similar to FIG. 2 showing the rotational parts in another position and with reels of insulated conductor mounted in the apparatus.

The cylindrical section 16 is secured to the lower domed end section 20 and the upper domed end section 18 is pivotally connected to the cylindrical section 16 at a pivotal position outwardly from the cylinder 12. As shown in FIG. 3, this pivotal position is provided by a hinge member 30. The hinge member 30 comprises part of a flyer means which also includes at least one ring 32 which is axially spaced from and is in axial alignment with the hinge member 30. As can be seen from FIG. 3, the ring 32 is secured to the cylindrical section 16.

Means is provided for rotating the flyer means around the axis of the cylinder 12. As can be seen from FIGS. 2 and 3 this rotating means comprises an electric motor 34 attached to the underside of the lower frame plate 28, the electric motor being drivably connected to the driving shaft 22 by means of a drive pulley belt 36.

In use of the apparatus as will be described, individually insulated conductors being passed through the apparatus will move in sliding engagement with the surfaces of the cylinder. So as to reduce frictional resistance to this movement to a minimum, all surfaces with which the conductors may engage are made as smooth and as friction resistant as possible. In addition, so as to reduce the moment of inertia of the rotating mass of the cylinder 12 when in use, it is convenient to use lightweight and strong materials. While metal may be used, the cylinder may be formed from a fiberglass polyester structure. The friction resistant surface upon the inside of the cylindrical section 16 and particularly around the outside of the domed end sections may be provided by an alloy of cobalt and nickel which provides high resistance to wear and low friction characteristics. Such a material is known under the trade name of Triballoy.

As shown in FIGS. 2 and 3, a die 38 is provided concentrically within the domed end section 18, the die provided for convergence of the lengths of insulated conductor as they pass out of the cylinder. At the other end of the cylinder, an inclined guide passage 40 is formed axially along the drive shaft 22 to guide the lengths of filamentary material from the flyer, the guide passage 40 terminating in an extension passage 42 which is coaxial with the axis of rotation of the cylinder 16. The extension passage 42 guides the filaments to a pulley 44 around which they pass at a second twist position before continuing away from the apparatus to a take-up reel (not shown).

The apparatus further comprises a mounting means for mounting two axially aligned reels of individually insulated copper conductor within the cylinder. The mounting means comprises a support shaft 46 which is held within the upper end of the drive shaft 22 within bearings 48. A suitable gear train 50 drivably connects the support shaft 46 with the drive shaft 22 for the purpose of ensuring that the support shaft 46 is held stationary relative to the frame 14 when the drive shaft 22 is rotated by the pulley belt 36. This type of gearing arrangement is well known in engineering fields, particularly in twisting machines for the telecommunications industry. Hence, no further description of this gearing arrangement is necessary.

As can be seen from FIG. 3, the die 38 is held within an axially extending collar 51 of the domed upper end section 18. The collar is provided with an outlet orifice 52 for passage of the conductors from the die to the hinge member 30 of the flyer means. The die 38 has an upwards extension 54 which is supported by bearings 56 within a surrounding cylindrical mount 58. The mount 58 is in turn secured to a radially extending planar flange 60 which is itself carried upon an upper plate 62 of the framework 30. The edges of the plate 62 are supported by linear bearings upon two parallel shafts 64 carried upon the frame 30 so as to allow the plate 62 to be moved horizontally. This movement is easily controlled manually. Extension 54 to the die 38 is provided with an axially extending passage 68 to assist in threading the insulated conductors through the die and out of the orifice 52 as will be described.

Two reels 70 and 72 which are to be mounted inside the cylinder 12 upon the support shaft 46 are reels commonly referred to as "Hearl Heaton" reels. These reels are capable of carrying a quantity of individually insulated conductor which is four times that which may be carried by half telephone reels normally mounted within a conventional double twisting machine as used in the telecommunications industry. Even though the Hearl Heaton reels are capable of carrying such a quantity of conductor, they are of such a diameter across their ends 74 that the cylinder 12 which is made sufficiently small in diameter to enable the conductor to pass comfortably between the ends 74 and the cylinder, locate the flyer means 30 and 32 at a small diameter of approximately 24 inches. This is far below the diameter normally possible with a flyer for providing double twist for conductor of a telecommunications cable. As shown in FIG. 3, the reels 70 and 72 are mounted one above the other upon the support shaft 46, the support shaft having an appropriately contoured upper surface to carry the reels under their own weight without any other support while ensuring that they are balanced vertically.

Figure 6:
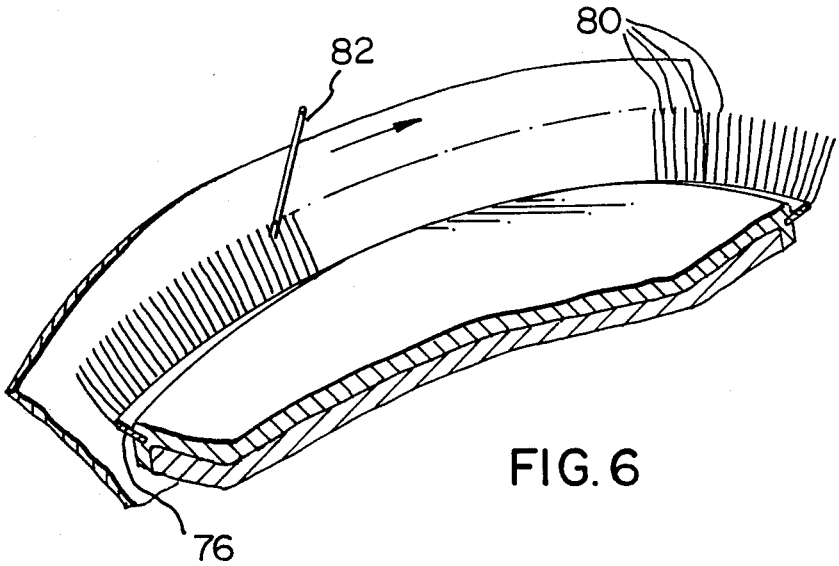
FIG. 6 is an isometric view of part of the apparatus taken in the direction of arrow V in FIG. 3.

The upper end flange 74 of the upper reel 72 is provided with means to prevent the conductors from dropping down into the cylinder under their own weight and thus prevent automatic unwinding of conductor upon stoppage in operation of the apparatus. This holding means must operate so as to hold the conductors upwardly while ensuring that there is a negligible increase in the frictional resistance to upward movement of the conductors in the cylinder 12. This requirement is provided by a brush 76 which is arranged around the end flange 74 by being mounted upon a support disk 78 connected to the flange as shown in FIGS. 3 and 6. The brush 76 has bristles 80 which extend outwardly while being inclined upwardly from the support 78 with the bristles 80 being sufficiently long so as to contact the inner surface of the cylindrical section 16 of the cylinder 12. If required, a similar brush may be arranged on the upper flange 74 of the lower reel 70.

Figure 4:
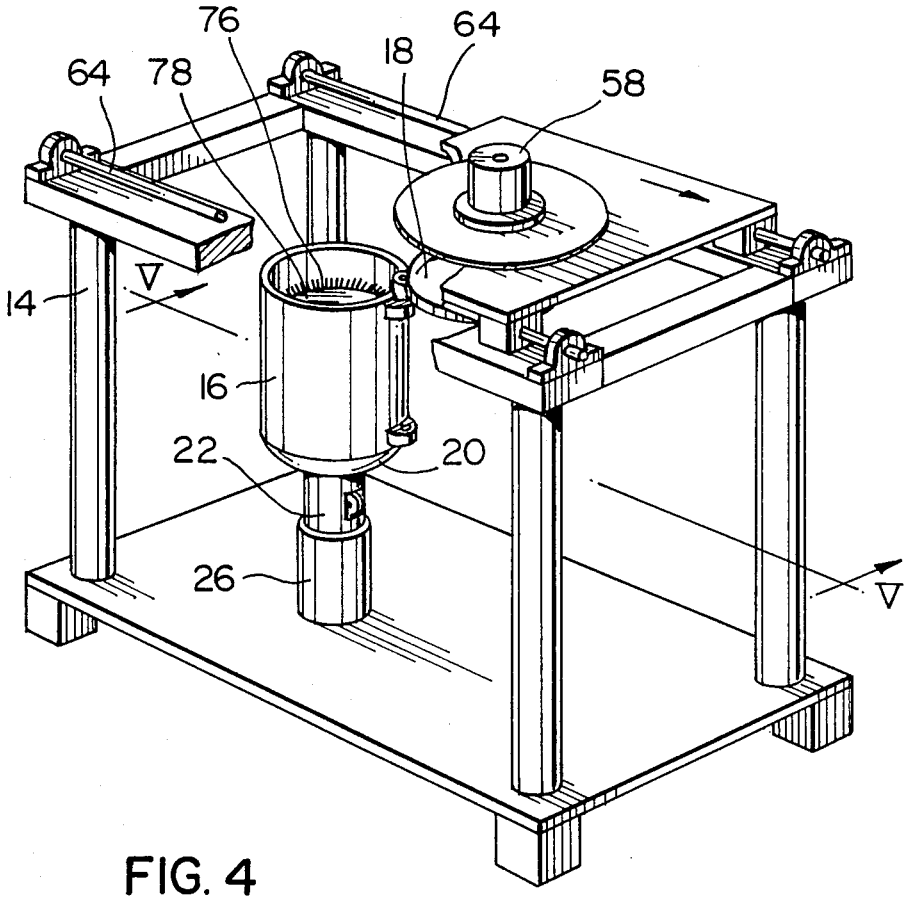
FIG. 4 is a view similar to FIG. 1 showing the apparatus in an open condition.
Figure 5:
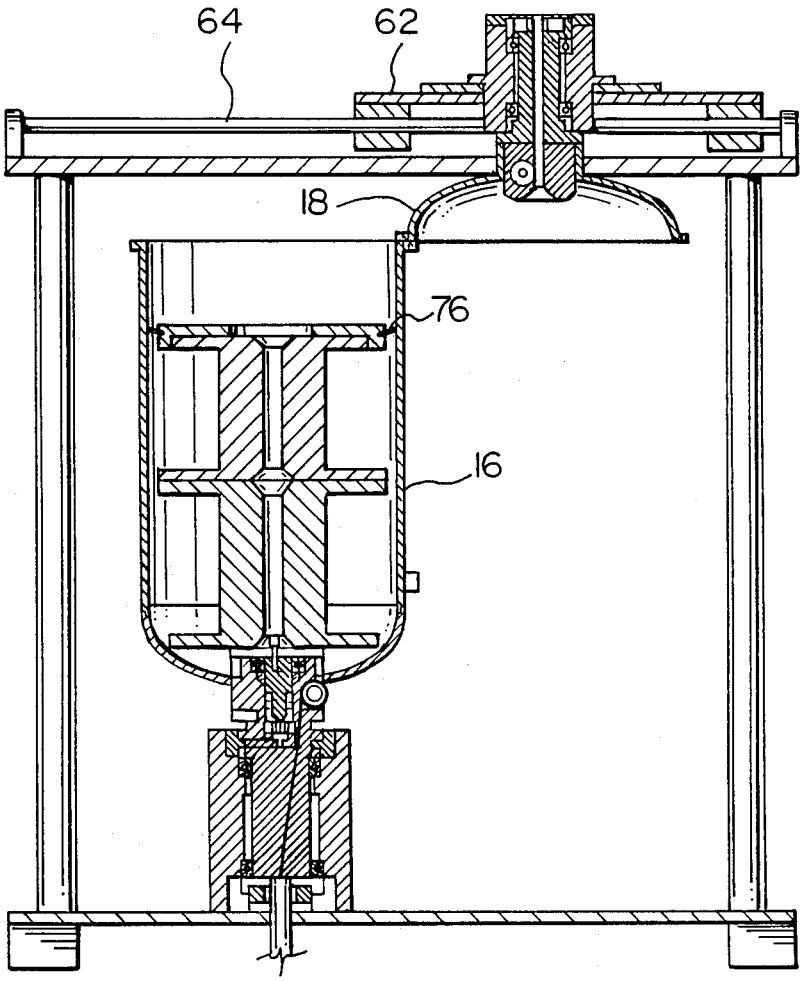
FIG. 5 is a cross-sectional view along line V—V in FIG. 4.
Figure 7:
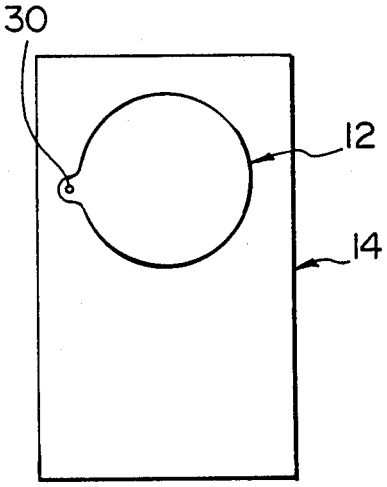
FIGS. 7 and 8 are diagrammatic plan views, respectively, of the positions of parts of the apparatus as shown in FIGS. 1 and 4.
Figure 8:
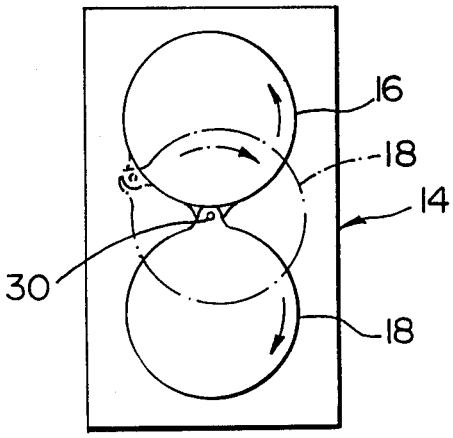

In use of the apparatus, the platform 62 is movable horizontally from the closed position of the apparatus shown in FIG. 1 to the open position shown in FIGS. 4 and 5. This action may only be made with the hinge member 30 in the position shown diagrammatically in FIG. 7, i.e. with the hinge member 30 disposed on a diametral line which is substantially at right angles to the direction of movement of the platform 62. As the platform 62 moves toward the position of FIG. 4 it causes the upper domed end section 18 to rotate in one direction about the hinge member 30 while the cylindrical section 16 rotates in the opposite direction relative to the hinge member as shown in FIG. 8. This movement is accompanied by positional change of the hinge member itself, from the position shown in FIG. 7 to the position shown in FIG. 8, so that the upper domed end section 18 moves away from its superimposed position upon the cylindrical section 16. This movement of the domed end section is permitted by relative rotation of the domed end section through its die extension 54 within the die holder 58 by means of the bearings 56. FIG. 8 illustrates an intermediate position for the domed end section 18 (in chain-dotted outline) with the hinge member 30 disposed at an intermediate position between its two limiting positions of FIGS. 7 and 8.

With the cylinder opened, as shown in FIGS. 4 and 5, the inside of the cylindrical section 16 is accessible for mounting the reels 70 and 72 in position. The reels 70 and 72 are supported upon the top of the shaft 46 which is suitably shaped to retain the reels balanced in position. This is performed with the leading ends of the insulated conductors 82 passed upwardly from the reels and located upon the top surface of the upper reel. The platform 62 is then moved back to its position as shown in FIG. 1 to close the apparatus. A suitable tool (not shown) is then passed down the passage 68 and through the die 38 to draw both of the conductors 82 up through the passage 68. It is then possible to pass another tool through the orifice 52 to draw both conductors from the passage 68 through the orifice 52. The conductors are then threaded through the hinge member 30 and through the ring or rings 32 and downwardly through the guide passage 40, passage extension 42, and around the pulley wheel 44 to the take-up reel (not shown). Alternatively, and to assist in drawing the conductors from the reels 70 and 72, two diametrically opposed circular holes 84 are provided in the domed end section 18 for passage of a human arm to grasp the conductors (FIG. 3).

The twisting operation commences by drawing the conductors together onto the take-up reel and by rotating the cylinder 12 with the rotating means described, the reels 70 and 72 remaining stationary by means of the gearing arrangement 50. The conductors 82 are drawn axially over the ends of the reels 70 and 72 and are unwound as they are pulled through the die 38. With the cylinder 12 rotating, then the conductors being lead from the reels within the cylinder tend to balloon outwards away from the center of rotation of the cylinder. However, the degree of ballooning is limited by the inner surface of the cylinder against which the conductors engage as they move upwardly, the conductors sliding over the substantially frictionless surface towards the die 38. As the cylinder 12 is only of sufficient diameter to enable the conductors to pass comfortably between the end flanges 74 and the cylinder, then the ballooning diameter of the conductors 82 is substantially no greater than the diameter of the flanges themselves. With ballooning restricted in this fashion, this means that the flyer means in the form of hinge member 30 and ring or rings 32 may be disposed inwardly to a minimal diameter position as described above. Upon the conductors passing through the die 38 and proceeding through the orifice 52, they are given a single twist around each other. The singly twisted conductors then proceed through the flyer means, at which some ballooning may appear dependent upon the number and distance apart of the rings 32, and then through the guide passage 40 and around the pulley wheel 44 at which a second twist is provided.

At the end of the twisting operation and upon the take-up reel becoming stationary, the conductors 82 do not tend to drop in the cylinder 12 so that unwinding of the conductors upon the reels and unwanted loosening of the conductors does not result. This is because of the use of the brush or brushes 76. As can be seen from FIG. 6, when the conductors are being drawn through the die 38, they also move circumferentially around the inside of the cylinder 12 during unwinding. This is shown by the arrow in FIG. 6. This movement causes the conductors to pass across the ends of the bristles 76 which are flexed out of the path of the conductor. However, upon stopping operation of the machine, the weight of the conductors immediately acts upon the bristles to push them downwardly so that the conductors are gripped by the inclined bristles against the inner surface of the cylinder so as to prevent their dropping.

As can be seen, in use of the apparatus, substantially all of the tension which is applied, is caused by the frictional engagement of the conductors with the surfaces of the cylinder and with the flyer means. The reels 70 and 72 are not rotated by the conductors as they are being unwound so that tension is not caused by resistance to rotation of the reels. Furthermore, no braking mechanisms are provided with the reels nor are there any tensioning pulleys used around which the conductors need to pass so that sudden and jerky applications of tensile load cannot occur with the use of this apparatus. In addition, no flybars are required for leading the conductors over the ends of the reels and which require the conductors themselves to rotate the flybars under frictional resistance. It follows that the resistance to movement of the conductors through the apparatus to the take-up reel is exceedingly small and is substantially constant. Hence the speed of the take-up reel may be increased or decreased at will without increasing the load upon the conductors. It has been found that conductors with extremely small diameters, e.g. down to at least 36 AWG may be provided with a double twist in the apparatus described in the embodiment. In addition, in this apparatus, the cylinder 12 may be rotated at a speed of at least up to 2400 r.p.m. without breakage of the conductors. Such a rotational speed provides 4800 twists per minute, the pitch of which is dependent upon the speed of take-up of the conductors.

In a modification of the embodiment, (not shown), the gear arrangement 50 is designed so as to provide rotational movement of the reels in the opposite direction to that of the cylinder 12. This rotational movement, which of course is not controlled by the conductors 82 themselves, will affect the number of twists per minute.

In another modification (not shown), the cylinder 12 is located with its axis of rotation disposed horizontally instead of vertically as described above. The design and operation of the horizontally disposed cylinder is as described above except that a mounting spindle is required for locating and holding the reels inside the cylinder. This spindle is secured to the support shaft 46.

We claim:

1. A method of twisting together at least two lengths of filamentary material with a double twist comprising:

causing the lengths of material to follow paths from reels of material located in axial alignment within a surrounding concentric cylindrical means, the paths extending in one axial direction from the reel surfaces and between the surrounding cylindrical means and ends of the reels to a first twist position axially beyond the reels, radially outwards from the cylindrical means to extend in the other axial direction through flyer means radially outside the cylindrical means and then axially away from the cylindrical means substantially on the axis thereof to a second twist position;

and drawing the lengths of material along their paths while rotating the flyer means around said axis, the lengths of material being unwound from the reels and forced, by speed of rotation, against the inner surface of the cylindrical means and sliding against said inner surface as they pass towards the first twist position.

2. A method according to claim 1 comprising retaining the reels stationary as the lengths of material are being drawn along their paths.

3. A method according to claim 1 comprising rotating the reels in the same direction as and at a slower speed than the cylindrical means as the lengths of material are being drawn along their paths.

4. A method according to claim 1 comprising passing the lengths of material between a flexible holding means and the inside surface of the cylindrical means as they move towards the first twist position, the holding means serving to hold the lengths of material against the inside surface of the cylindrical means and resist slackening of the lengths upon termination of the twisting operation.

5. Apparatus for twisting together at least two lengths of filamentary material with a double twist comprising:

a cylindrical means with a smooth inner surface;

mounting means within and at a first end of the cylindrical means for at least two axially aligned reels of filamentary material with the reels substantially concentric with the cylindrical means;

a die concentrically disposed at a second end of the cylindrical means for causing convergence of the lengths and for leading them to a first twist position;

flyer means for the lengths of filamentary material, the flyer means located radially outside the cylindrical means for directing the lengths axially from the second end towards the first end of the cylindrical means;

means for rotating the guide means concentrically around the axis of the cylindrical means;

and a second twist position disposed axially beyond the first end of the cylindrical means.

6. Apparatus according to claim 5 wherein the flyer means extend axially along the outer surface of the cylindrical means and the rotating means rotate the cylindrical means around its axis and around the mounting means.

7. Apparatus according to claim 6 wherein a drive shaft is secured to and extends axially beyond the first end of the cylindrical means, the drive shaft rotatably held in a frame and formed with a guide passage for guiding the lengths of filamentary material from the flyer means to the second twist position.

8. Apparatus according to claim 7 wherein the mounting means is carried by the shaft for relative rotation between the mounting means and the shaft, and drive means connects the shaft and mounting means to prevent rotation of the mounting means when the shaft is rotated by the rotating means.

9. Apparatus according to claim 7 wherein the mounting means is carried by the shaft to cause rotation of the mounting means at a slower angular speed than the shaft when the shaft is rotated by the rotating means.

10. Apparatus according to claim 5 wherein the cylindrical means has end sections defining smooth radially outer surfaces for sliding engagement by the lengths of filamentary material.

11. Apparatus according to claim 6 wherein the flyer means comprises a plurality of rings spaced apart along and secured to the cylindrical means which is provided with a smooth outer surface for sliding engagement by the lengths of filamentary material.

12. Apparatus according to claim 6 wherein at its second end, the cylindrical means is provided with an end section for closing the cylindrical means and which defines the first twist position, the end section being removable to enable reels to be passed into and out of the cylindrical means and having an access opening to the outlet from the cylindrical means to enable lengths of material to be drawn from the reels to the outlet.

13. Apparatus according to claim 12 wherein the end section is pivotally mounted upon the cylindrical means about an axis coincident with the axis of the guide means.

14. Apparatus according to claim 13 wherein the end section is mounted upon a carrier which is movable laterally of the axis of the cylindrical means to move the end section between a position closing the cylindrical means and a position removed from the closed position, the end section being freely pivotable upon the carrier whereby lateral movement of the carrier will effect pivotal movement of the end section in one direction about its pivotal axis to the cylindrical means accompanied by pivotal movement of the cylindrical means in the opposite direction about said pivotal axis.

15. Apparatus according to claim 14 wherein the cylindrical means is rotatably carried by a frame and the carrier is slidably carried by the frame to effect lateral movement of the carrier.

16. Apparatus according to claim 1 and including two reels disposed coaxially within the cylindrical means, at least one of said reels including a means for flexibly holding the lengths of filamentary material against the inner surface of the cylindrical means upon termination of a twisting operation.

17. Apparatus according to claim 16 wherein the flexible holding means comprises a brush secured to and extending around the outer periphery of one end of at least one of the reels, the brush having bristles which extend radially outwardly and inclined in the direction of movement of the lengths of material along the cylindrical means, outer edges of the bristles flexibly engaging the inner surface of the cylindrical means.

* * * * *